US005143012A

United States Patent [19]

Elkowitz

[11] Patent Number: 5,143,012

[45] Date of Patent: Sep. 1, 1992

[54] INFLATABLE TEMPORARY BOAT HULL SEAL ASSEMBLY

[76] Inventor: Marc J. Elkowitz, 28 Lighthouse Rd., Kings Point, N.Y. 11024

[21] Appl. No.: 730,461

[22] Filed: Jul. 16, 1991

[51] Int. Cl.[5] ..... B63B 43/16

[52] U.S. Cl. ..... 114/227; 114/228

[58] Field of Search ..... 114/227, 228; 441/92, 441/93, 94, 96

[56] References Cited

U.S. PATENT DOCUMENTS

| | | | |
|---|---|---|---|
| 752,654 | 2/1904 | Clews, Jr. et al. | 441/53 |
| 1,195,013 | 8/1916 | Hieggby | 114/228 |
| 3,638,258 | 2/1972 | Black | 441/92 |
| 3,841,256 | 10/1974 | Etchelecon | 114/227 |
| 5,058,519 | 10/1991 | Collins | 114/227 |

FOREIGN PATENT DOCUMENTS

| | | | |
|---|---|---|---|
| 320 | of 1896 | United Kingdom | 114/227 |

*Primary Examiner*—Sherman D. Basinger
*Attorney, Agent, or Firm*—Dilworth & Barrese

[57] ABSTRACT

An apparatus for temporarily sealing a hole in the hull of a boat comprising an inflatable seal portion disposed adjacent the outer surface of the hull, means for inflating said seal portion and a structural support portion disposed adjacent the inner surface of the hull to maintain said seal portion in intimate contact with the hull of the ship to prevent the flow of water therethrough.

9 Claims, 2 Drawing Sheets

INFLATABLE TEMPORARY BOAT HULL SEAL ASSEMBLY

BACKGROUND OF THE INVENTION

The walls of marine vehicles are thin. In particular, on a wooden boat the planking may be one and a quarter inches thick, on a fiberglass boat something less than half an inch thick, and on a steel yacht not more than three-sixteenths of an inch. A common cause of a serious leak in the hull of a ship is a faulty skin fitting or a collision with a large and heavy piece of timber, sandbars, submerged reefs, or a floating piece of deck cargo washed overboard from a ship. Yachts have been damaged and sunk by whales and they have been attacked and seriously holed by swordfish. The hulls of naval vessels have been damaged from collisions with floating or bottom moored mines. In general, a leak is likely to occur proximate to a ships forward quarter, near the water line of the ship.

Upon detecting a leak in the hull of his/her ship, there are many emergency measures that a sailor may take depending upon the material of the hull and the extent of a leak therein. Damage may be repaired from the inside with a patch of sheet lead or copper. Lead is better than copper for these purposes because it takes to the contour of the hull much more easily and on a wooden hull, requires nothing behind it but a thick layer of sealant. With a fiberglass hull, lead can be fastened in place with short self-tapping screws. Holes must first be drilled in the hull. With a steel hull, it may be possible to hammer the plates together or to shore the leak up from the inside using struts braced against the deck-head or a bulkhead. Furthermore, a strong mix of sand and cement will often stop leaks by pouring it into a roughly constructed box over the leak.

The known methods of shoring up a leak in the hull of a boat are extremely time consuming and require the sailor to stow tools and materials on board at all times.

It is therefore a primary object of the subject invention to provide a universal hull sealing device that may be installed quickly and with little effort so as to effectively stop the flow of water therethrough.

It is a further object of the subject invention to provide a universal hull sealing device adapted for use with wood, steel or fiberglass hulls.

It is a further object of the subject invention to provide a universal hull sealing devise adapted for use with hulls of any thickness.

It is a further object of the subject invention to provide a universal hull sealing devise which operates internally and externally from the hull so as to enable installation thereof without working against hydrostatic pressure.

It is another object of the subject invention to provide a universal hull sealing device which may be conveniently stowed.

SUMMARY OF THE INVENTION

The temporary inflatable boat hull seal assembly of the subject invention basically comprises a generally circular inflatable seal portion employed outside of the hull fitted to a support structure disposed inside the hull to ensure that the inflatable seal portion remains in intimate contact with the outer surface of the hull. The inflatable hull seal assembly of the subject invention is intended to provide a universal seal to prevent water from entering a hole in the hull of a ship caused by a collision with another ship, floating debris or an underwater obstruction.

The inflatable seal portion of the hull seal assembly of the subject invention is preferably constructed of a woven material having a significant shearing strength, whereby the inflatable seal portion will not be susceptible to tearing and puncturing while in service. While deflated the seal portion is stored in a flexible enclosure attached to the support structure.

The support structure of the subject invention comprises an elongated tubular member having a threaded portion on its distal end. A threaded collar is engaged on the threaded portion of the tubular member and is substantially adjustable along the length thereof. A plurality of outwardly extending support legs are connected to the threaded collar. The legs may be telescoped by depressing a spring loaded detent. Furthermore, the legs may be provided with articulated two bar linkages connected to the collar to ensure that they remain fully extended during deployment.

A canister of compressed material is disposed within the elongated tubular member intermediate the distal ends thereof. The container includes a valve and stem arrangement which extends through the wall of the tubular member to regulate the flow of material therefrom. A flexible conduit extends out of the container of compressed material and terminates within the inflatable body portion.

In operation, upon detecting a hole in a ships' hull a sailor may quickly deploy the temporary hull seal assembly of the subject invention by extending the flexible storage enclosure through the hole such that it is adjacent to the outer surface of the hull of the ship. Thereafter, the legs of the support structure of the hull seal assembly may be engaged against the inner surface of the ship's hull. At such a time, a sailor may open the valve which regulates the flow of the compressed material so as to rapidly inflate the seal portion of the assembly. Upon inflating the seal portion the pressure of the water against the surfaces thereof will force the seal against the outer surface of the hull to achieve a secure barrier against water entering the hole in the hull of the ship. Subsequently, the threaded collar may be rotated so as to further enhance the integrity of the seal. The resulting temporary seal will permit the sailor to safely return to port without compromising his craft.

The within-the-hull arrangement of the support structure of the subject invention permits the sailor to deploy the hull seal assembly without having to work against the hydrostatic pressure of the water outside the hull. Furthermore, the within-the-hull arrangement of the support structure of the subject invention ensures that the hull seal assembly remains stable in rough waters.

DETAILED DESCRIPTION OF THE PREFERRED EMBODIMENT

Figure 1:
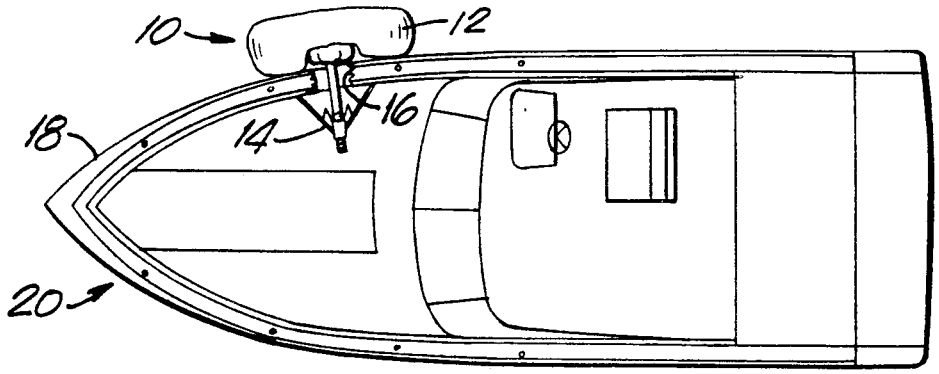
FIG. 1 is a top plan view of the temporary inflatable boat hull seal assembly of the subject invention in it's intended environment.

The temporary inflatable boat hull seal assembly of the subject invention is illustrated in FIG. and is designated generally by reference numeral 10. The temporary inflatable hull seal assembly 10 basically comprises an inflatable seal portion 12 and a structural support portion 14. The inflatable hull seal assembly 10 is employed to quickly seal a hole 16 in the hull 18 of a boat 20 so as to prevent the passage of water therethrough.

Figure 2:
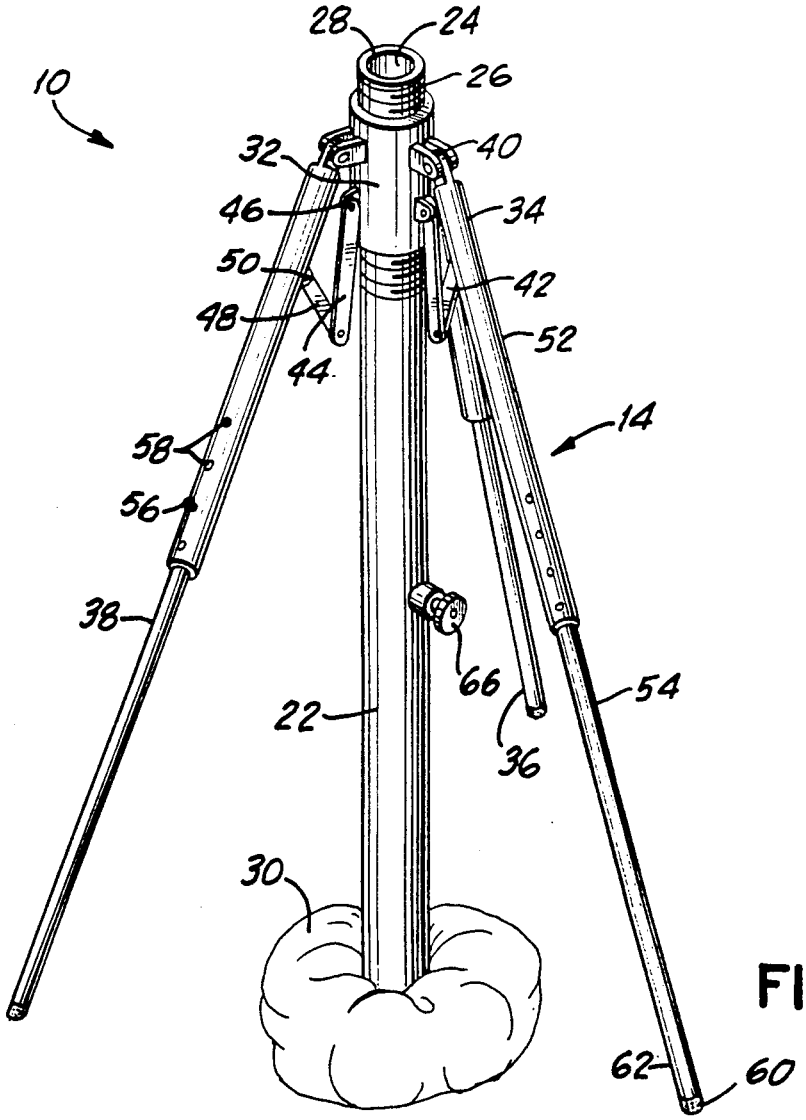
FIG. 2 is a perspective view of the temporary inflatable boat hull seal assembly of the subject invention.

Referring to FIG. 2, the structural support portion 14 of the temporary hull seal assembly 10 of the subject invention comprises an elongated tubular member 22 having an axial bore 24 extending therethrough. The tubular member 22 includes a threaded portion 26 disposed adjacent to the distal end 28 thereof. The structural support portion 14 further includes a generally circular enclosure 30 extending from the tubular member 22 for housing the seal portion 12 in its deflated condition. The enclosure 30 is preferably constructed of a flexible material that may be easily contorted so as to extend through hull breaches of differing size and shape.

The structural support portion 14 of the temporary inflatable hull seal assembly 10 of the subject invention further includes a cylindrical collar 32 engaged on the threaded portion 26 of the tubular member 22 which is movable relative to the longitudinal axis thereof. Extending from the cylindrical collar 32 are first, second an third telescoping support legs 34, 36 and 38. Each of the support legs 34, 36 and 38 are hinged to the collar 32 by primary joints 40 disposed in spaced apart relationship about the circumference of the collar 32. An articulating two bar linkage 42 is provided for maintaining each of the support legs 34, 36 and 38 in an outwardly extended condition when the temporary inflatable hull seal 10 is deployed. An articulating linkage 42 includes a first bar 44 which is hinged to the cylindrical collar 32 by a secondary joint 46 disposed adjacent to a primary joint 40, and a secondary bar 48 which is hinged to a support leg 34, 36 and 38, at a tertiary joint 50 disposed intermediate the length thereof.

Each of the telescoping support legs 34, 36 and 38 includes a fixed section 52 and a slidable section 54. The slidable section 54 may be incrementally extended by depressing a spring loaded detent mechanism 56 which is provided within the fixed section 52 and which may be engaged in one of a plurality of apertures 58 disposed along the length thereof. A rubber foot 60 is disposed on the distal end 62 of the outwardly extending section 54 of each of the telescoping support legs 34, 36 and 38 to prevent the support structure 14 from slipping while deployed against the inner surface 72 of the ship's hull 18.

Figure 3:
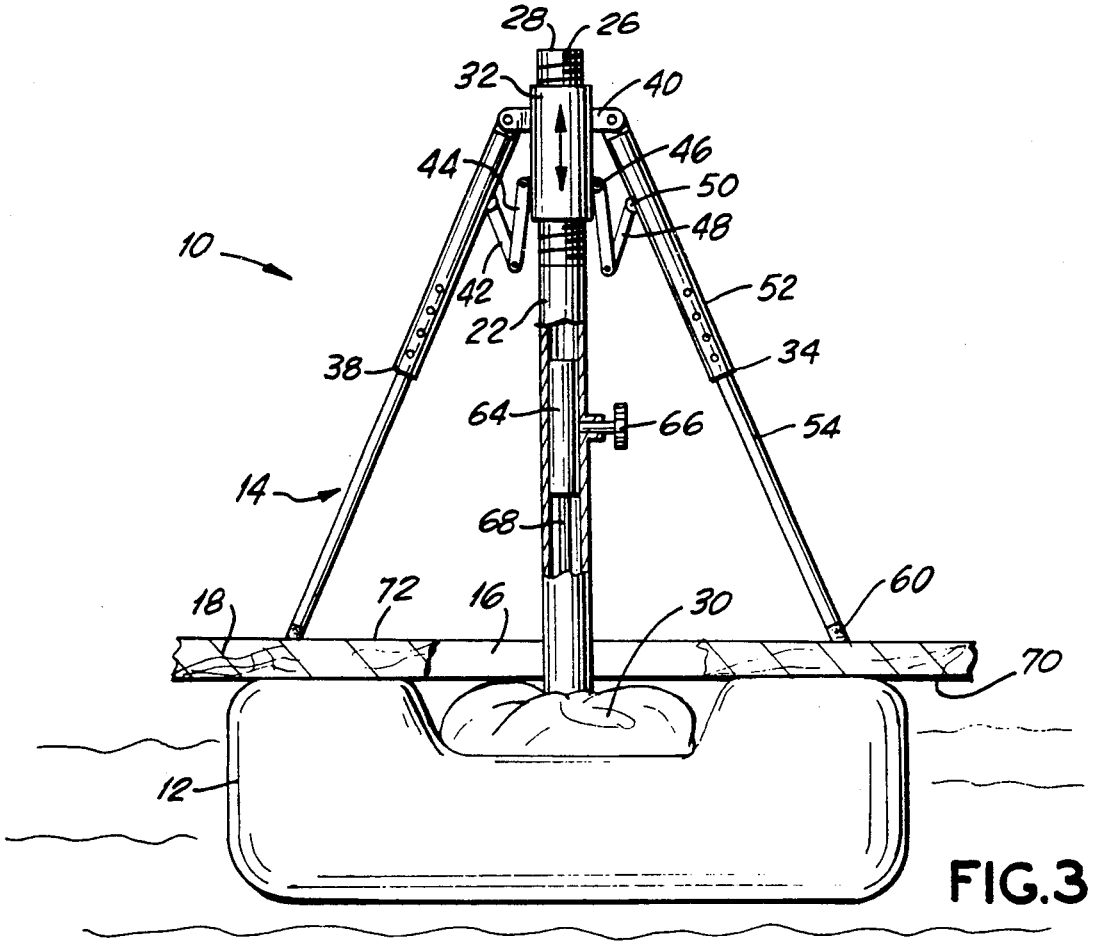
FIG. 3 is a side elevational view of the temporary inflatable boat hull seal assembly of the subject invention employed in a hole in the hull of a ship.

Turning to FIG. 3, the temporary inflatable hull seal assembly 10 of the subject invention further comprises a generally circular inflatable seal portion !2 which is preferably constructed of a woven material such as Kevlar® that is substantially resistant to tearing or puncturing under conditions of high stress or strain. Alternatively, the seal portion 12 may be mushroom shaped to achieve a more intimate fit with a breach in the boat's hull. Furthermore, the seal portion 12 may comprise reinforced multiple plies of material.

The hull seal assembly 10 further comprises a canister 64 disposed in the axial bore 24 of the tubular member 22 of the structural support portion 14 containing a volume of compressed gas or a dry chemical for inflating the seal portion 12. The canister 64 contains a volume of compressed material that is approximately equal to the volume of the inflatable seal portion 12. The canister 64 is provided with a regulating valve 66 and with a flexible conduit 68 extending therefrom and terminating within the seal portion 12 of the hull seal assembly 10. The regulating valve 66 is provided to regulate the rapid flow of compressed material from the canister 64, through the flexible conduit 68 and into the seal portion 12.

Figure 4:
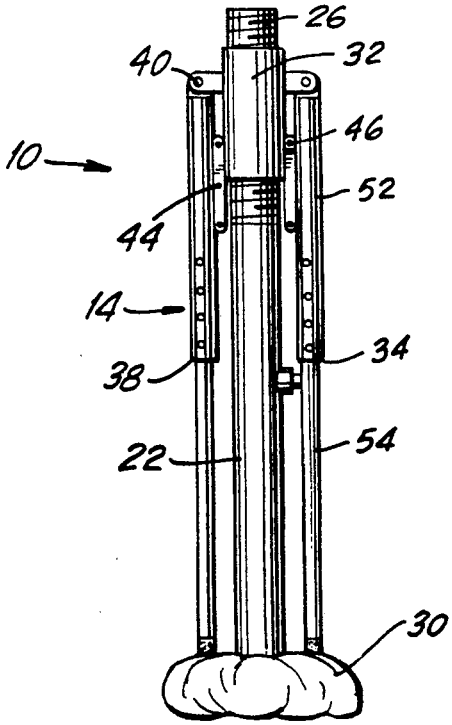
FIG. 4 is a side elevational view of the temporary inflatable boat hull seal assembly of the subject invention in the deflated condition.

In operation, upon detecting a hole 26 in the hull 18 of a ship 20 a sailor may retrieve the temporary hull seal assembly 10 of the subject invention, which is stowed in a collapsed condition as illustrated in FIG. 4. At such a time, the sailor may extend the seal enclosure 30 through the hole 16 in hull 18 such that it is adjacent to the outer surface 70 of the hull 18. Thereafter, the support legs 34, 36 and 38 may be outwardly articulated and the slidable sections 54 thereof may be extended so as to firmly secure the structural support portion 14 of the hull seal assembly 10 against the inner surface 72 of the hull 18. Thereupon, the regulating valve 66 may be manually turned to an open position so as to inflate the seal portion 12 of the hull seal assembly 10. Once the seal portion 12 is fully inflated the cylindrical collar 32 may be rotated and tightened down so as to increase the integrity of the temporary seal. At such a time, the hydrostatic pressure of the water acting on the inflatable seal portion 12 and the rigid structural support portion 14 acting against the inner surface 72 of the ship's hull !8 ensures that the inflatable seal portion 12 remains in intimate contact with the outer surface 70 of the hull 18, thereby preventing the passage of water through the hole 16. Furthermore, the rigid structural support portion 14 ensures that the hull seal assembly 10 remains stable in rough waters.

While the invention has been described with respect to a preferred embodiment, it is apparent that modifications can be made without departing from the spirit of the invention as defined by the appended claims. For example, the structural support portion of the boat hull seal assembly may comprise an elongated rectangular member having a centrally located circular aperture extending therethrough to engage the elongated tubular member of the support portion. The rectangular member may be selectively fastened along the length of the elongated tubular member of the support portion with a set screw to maintain the inflatable seal portion in intimate contact with the ship's hull.

I claim:

1. An apparatus for temporarily sealing a hole extending from an inner surface to an outer surface of a hull of a boat comprising:

structural support portion including an elongated tubular member having opposed first and second ends, said tubular member having means for maintaining said support portion adjacent one of said surfaces of said boat hull;

generally circular inflatable hull seal portion extending from the second end of the elongated tubular member which when inflated is disposed adjacent to and in intimate contact with the other of said surfaces;

a container holding a volume of compressed material sufficient to fully inflate said inflatable hull seal portion, said container disposed in said elongated tubular member of said structural support portion, said container having a valve associated therewith and a flexible conduit extending therefrom for directing a rapid flow of compressed material into said inflatable seal portion, whereby said apparatus may be deployed by extending said inflatable seal portion through said hole and thereupon inflating said seal portion such that it is in intimate contact with one of said surfaces of said hull to prevent the passage of water though said hole.

2. An apparatus as in claim 1 wherein said inflatable seal portion is made of a woven material having a significant shearing strength.

3. An apparatus as in claim 1 wherein said means for maintaining said structural support portion adjacent one of said surfaces of said hull comprises a plurality of outwardly extending legs, said legs being hingedly connected to a threaded collar said threaded collar being adjustable along the length of said elongated tubular member of said support portion adjacent to the first end thereof.

4. An apparatus as in claim 3 wherein said plurality of outwardly extending legs comprises first, second and third spaced apart legs, the spacing between said legs being approximately 120°.

5. An apparatus as in claim 3 wherein said outwardly extending legs are telescopic.

6. An apparatus as in claim 1 wherein said compressed material is a gas.

7. An apparatus as in claim 1 wherein said compressed material is a powdered chemical.

8. An apparatus for temporarily sealing a hole extending from an inner surface to an outer surface of a hull of a boat comprising:

a structural support portion including an elongated tubular member having opposed first and second ends, said tubular member having a threaded collar adjacent said first end thereof being adjustable along the length thereof, said structural support portion including first, second and third spaced apart outwardly extending telescopic legs hingedly connected to said threaded collar, said legs provided for maintaining said support portion adjacent one of said surfaces, first, second and third articulated linkages, each of said linkages including elongated first and second bars, each of said first bars hingedly connected to said threaded collar, each of said second bars hingedly connected to one of said outwardly extending legs;

a generally circular inflatable hull seal portion extending from said second end of said elongated tubular member which when inflated is disposed adjacent to and in intimate contact with the other of said surfaces; and a container holding a volume of compressed gas sufficient to fully inflate said inflatable hull seal portion, said container disposed in said elongated tubular member of said structural support portion, said container having a valve associated therewith and a flexible conduit extending therefrom for directing a rapid flow of compressed gas into said inflatable seal portion, whereby said apparatus may be deployed by extending said inflatable seal portion through said hole and thereupon inflating said seal portion such that it is in intimate contact with one of said surfaces of said hull to prevent the passage of water through said hole.

9. An apparatus of claim 8 wherein said inflatable seal portion is made of a woven material having a significant shearing strength.

* * * * *